US010654008B2

(12) United States Patent
Eggler

(10) Patent No.: US 10,654,008 B2
(45) Date of Patent: May 19, 2020

(54) BAFFLE PIPE SEGMENT, INJECTOR DEVICE AND DISSOLVING INSTALLATION

(71) Applicant: Tetra Laval Holdings & Finance S.A., Pully (CH)

(72) Inventor: Thomas Eggler, Rothrist (CH)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 75 days.

(21) Appl. No.: 15/755,106

(22) PCT Filed: Sep. 15, 2016

(86) PCT No.: PCT/EP2016/071890
§ 371 (c)(1),
(2) Date: Feb. 26, 2018

(87) PCT Pub. No.: WO2017/050639
PCT Pub. Date: Mar. 30, 2017

(65) Prior Publication Data

US 2019/0336923 A1 Nov. 7, 2019

(30) Foreign Application Priority Data

Sep. 24, 2015 (SE) ..... 155229

(51) Int. Cl.
*B01F 5/04* (2006.01)
*B01F 1/00* (2006.01)
*B01F 5/06* (2006.01)

(52) U.S. Cl.
CPC ..... *B01F 5/0415* (2013.01); *B01F 1/0022* (2013.01); *B01F 5/043* (2013.01); *B01F 5/061* (2013.01)

(58) Field of Classification Search
CPC ..... B01F 5/04
(Continued)

(56) References Cited

U.S. PATENT DOCUMENTS 212,072 A * 2/1879 Walker ..... E04H 12/28 52/218
385,292 A * 6/1888 Baltzley ..... E03F 3/04 137/454.2

(Continued)

FOREIGN PATENT DOCUMENTS

EP 0486933 5/1992
GB 976578 11/1964

OTHER PUBLICATIONS

International Search Report from corresponding PCT Application No. PCT/EP2016/071890 dated Nov. 1, 2017 (2 pages).

(Continued)

*Primary Examiner* — David L Sorkin
(74) *Attorney, Agent, or Firm* — Finnegan, Henderson, Farabow, Garrett & Dunner LLP

(57) ABSTRACT

A baffle pipe segment (1) as obstacle in a flow of a target liquid through the baffle pipe segment (1), comprising a baffle element (3) arranged in the path of the target liquid, wherein a slit (14) for passage of the target liquid is formed between a segment hull (8) of the baffle pipe segment (1) and the baffle element (3). The baffle element (3) comprises at least one first positive curvature (3*a*) towards the input side. The slit (14) is delimited by an inner wall (14*a*) and an outer wall (14*b*), wherein the inner wall (14*a*) is formed by a wall section of the baffle element (3) and the outer wall (14*b*) of the slit (14) is formed by a section of the segment hull (8). The slit (14) extends in a perpendicular direction to the longitudinal axis (z) along a section of the circumference of the segment hull (8). And an injector device (7) with such a baffle pipe segment (1) and a dissolving installation (50) with such an injector device (7).

8 Claims, 3 Drawing Sheets

Figure 1:
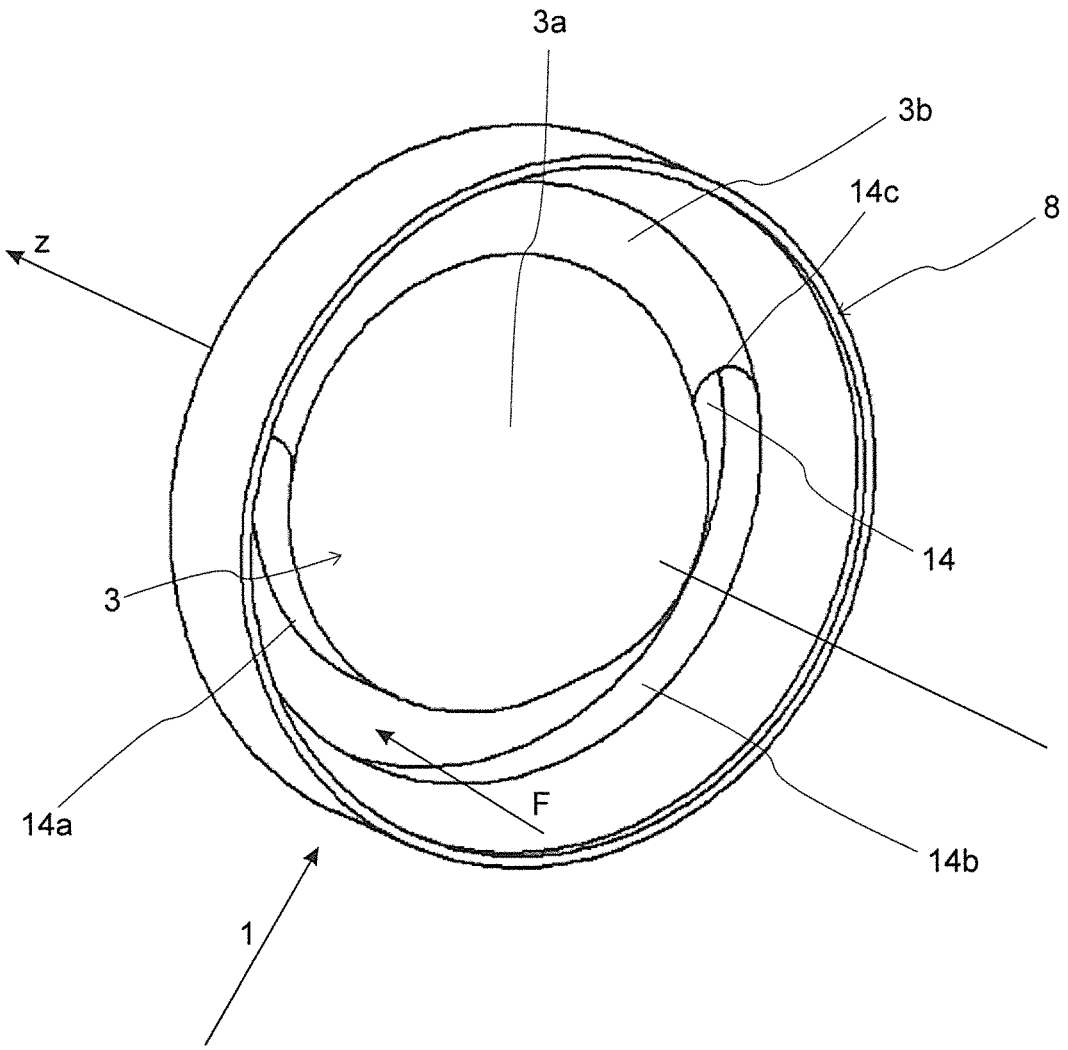

(58) Field of Classification Search
USPC ..... 366/158.5, 181.5; 138/42, 44
See application file for complete search history.

(56) References Cited

U.S. PATENT DOCUMENTS

| | | | | | |
|---|---|---|---|---|---|
| 1,043,644 | A * | 11/1912 | Thomas | B01F 5/0451 | 366/175.2 |
| 1,496,345 | A * | 6/1924 | Lichtenthaeler | B01F 5/0451 | 366/165.2 |
| 1,626,487 | A * | 4/1927 | Warren | B01F 5/0405 | 366/163.2 |
| 2,645,463 | A * | 7/1953 | Stearns | B01F 5/0403 | 366/158.5 |
| 2,669,946 | A * | 2/1954 | Peyton | A23G 9/282 | 366/173.2 |
| 2001/0038575 | A1 * | 11/2001 | Mathys | B01F 5/0451 | 366/181.5 |
| 2005/0189081 | A1 | 9/2005 | Kapila | | |
| 2011/0240753 | A1 | 10/2011 | Stevenson | | |

OTHER PUBLICATIONS

Office Action from corresponding Swedish Application No. 1551229-6 dated Feb. 19, 2016 (30 pages).

* cited by examiner

BAFFLE PIPE SEGMENT, INJECTOR DEVICE AND DISSOLVING INSTALLATION

CROSS-REFERENCE TO RELATED PATENT APPLICATIONS

This is a National Phase of International Application No. PCT/EP2016/071890, filed Sep. 15, 2016, which claims the benefit of Swedish Application No. 1551229-6, filed Sep. 24, 2015. The entire contents of the above-referenced applications are expressly incorporated herein by reference.

TECHNICAL FIELD

The invention relates to the field of dissolving a solid material, particularly powder or granulate, or a liquid in a target liquid.

BACKGROUND

Devices for dissolving a powder or granulate in a liquid are known.

EP 0 486 933 B1 describes an apparatus for dissolving solid bunk material in a liquid, in the following called target liquid, located in a container. The device has a first feed line for the solid bunk material and a second feed line for the liquid. Furthermore a circulation line is provided, which recirculates the liquid with material dissolved therein into the container. The container has an exit nozzle facing a baffle disc arranged in such a way that the circulating liquid together with solid material added into the circuit impinge the baffle disc when they exit the nozzle.

A disadvantage of the described solution is that it takes much vertical space due to its construction, as the lines for the solid bunk material and the circulation line have to be substantially vertical in the area where they come together. Therefore, flexibility of an installation containing said apparatus is limited in terms of space.

A further disadvantage is that the dissolution is relatively slow and adhesion or clogging or depositions of solid material at the baffle disc has been observed, thus leading to a high maintenance effort of regularly cleaning the area around the baffle disc. This drawback has particularly been noticed in case of dissolution of sugar in a sugar solution.

SUMMARY

It is an objective to increase constructive flexibility of dissolving devices and improve efficiency of dissolution.

The objective is solved by the independent claims.

In a first aspect of the invention a baffle pipe segment as obstacle in a flow of a target liquid through the same comprises a segment hull with a longitudinal axis and a baffle element arranged in the path of the target liquid and attached to the segment hull. The baffle element separates the baffle pipe segment into an input side arranged upstream of the baffle element with respect to a flow direction of the target liquid through the baffle pipe segment, and an output side arranged downstream of the baffle element with respect to the flow direction of the target liquid through the baffle pipe segment. A slit is formed between the segment hull and the baffle element, through which slit the target liquid flows from the input side to the output side. The baffle element comprises at least one first positive curvature towards the input side. The first curvature forms at least a section of a total surface of the baffle element facing the input side. The slit is delimited by an inner wall and an outer wall. The inner wall is formed by a wall section of the baffle element, which wall section extends substantially in direction of the longitudinal axis. The outer wall of the slit is formed by a section of the segment hull, wherein the slit extends in a perpendicular direction to the longitudinal axis along a section of the circumference of the segment hull. The segment hull is preferably tubular.

The design of the baffle pipe segment has an effect of increasing a flow speed of the target liquid through the slit, as the liquid previously flowing through the entire cross-section of the baffle pipe segment has to traverse the comparatively small cross-section of the slit. Consequently, the target liquid has a high ability of creating turbulences on the output side of the pipe segment, which is desired for a more effective dissolution.

In a second aspect of the invention an injector device for dissolving material in a target liquid comprises at least a baffle pipe segment according to the first aspect of the invention. It further comprises a first pipe segment for transporting a mixture composed of the target liquid and the material dissolved therein, a second pipe segment, connected to the first pipe segment, for supplying the target liquid into the first pipe segment, and a third pipe segment, connected to the first pipe segment, for supplying the material into the first pipe segment. Advantageously, the injector device can be inserted into an installation for dissolving a liquid at a desired location, as it is a standalone module.

In one version of the injector device the baffle pipe segment is attached inside the first pipe in a path of the target liquid.

In another version of the injector device the baffle pipe segment is attached between the first pipe segment and the second pipe segment. Preferably the baffle pipe segment is attached perpendicularly to the longitudinal axis.

In both versions the baffle pipe segment is arranged in such a way along the longitudinal axis that the second pipe segment is connected on its input side and the third pipe segment is connected on its output side. In both versions the baffle pipe segment has such a rotational position about the longitudinal axis, that a distance between the slit of the baffle pipe segment and an outlet of the third pipe segment is maximal.

Advantageously, the injector device with a baffle pipe segment allows a better dissolution of the material in the target liquid due to the arrangement of the material input on the output side, thus downstream of the baffle pipe segment, as strong turbulence is achieved in an area directly following the baffle element on the output side. Furthermore, clogging and depositions are avoided, as a pronounced suction effect for the material is achieved in an area directly following the baffle element on the output side. It has been observed that a desired side effect takes place in the injector device, consisting in the fact that no splashing occurs towards the output of the third pipe, as there is no direct impact between the baffle element and the inserted material. Said advantages will become more apparent in the context of the description of preferred embodiments of the invention. Additionally, the injector device with a baffle pipe segment can be used as finished module which is easily insertable into a processing installation by connecting the free ends of the first, the second and the third pipe to corresponding outlet or supply pipes, respectively.

In a third aspect of the invention a dissolving installation for dissolving a solid or liquid material comprises at least an injector device according to the second aspect of the invention, further comprising at least a first supply container for providing the target liquid, connected to the second pipe segment, at least a first pump for transporting the target liquid from the first supply container through the second pipe segment towards the first pipe segment, and at least a material dosage unit for regulating a quantity of the material to be supplied into the first pipe segment per time unit.

Advantageously, a dissolving installation with one or more dissolving devices according to the second aspect of the invention has been found to be more energy efficient than ordinary solutions, as the material can be directly sucked out of a silo containing the material (suction effect by target liquid), as contrary to known solutions where the material has to be brought to the dissolving device.

Preferably, the first pump is a variable flow pump, in other words it allows regulating the liquid quantity of liquid conveyed by it. This allows a higher flexibility with respect to the optimum flow speed of the target liquid in order to achieve the best dissolution.

In embodiments, the dissolving installation either is used for batch-wise or continuous dissolution of the material into the target liquid, preferably in food industry. This makes the dissolving installation is flexible with respect to the method of usage. For example, the dissolving installation according to the third aspect of the invention is suitable for unloading a silo truck, e.g. containing the material to be dissolved in powder state.

In embodiments, the dissolving installation is used for mixing a plurality of ingredients into the target liquid, wherein a batch of injector devices are arranged in series along a main pipe of the dissolving installation. Thus, a further advantage is the possibility of employing a series of injector devices according to the second aspect of the invention in one dissolving installation. For example, a plurality of ingredients can be mixed into the target liquid, each of which is introduced via an own injector device.

It is noted that not only solid material, like powders and granulates, can be dissolved in the target liquid, but also other liquids can be used instead of the powder or granulate. In this case the turbulence mentioned above is particularly useful, as it substantially contributes to a fast mixing of the two liquids. Certainly, in an application with multiple injector devices also a combination of e.g. powder and liquids to be introduced into the target liquid is conceivable.

SHORT DESCRIPTION OF THE DRAWINGS

Figure 2:
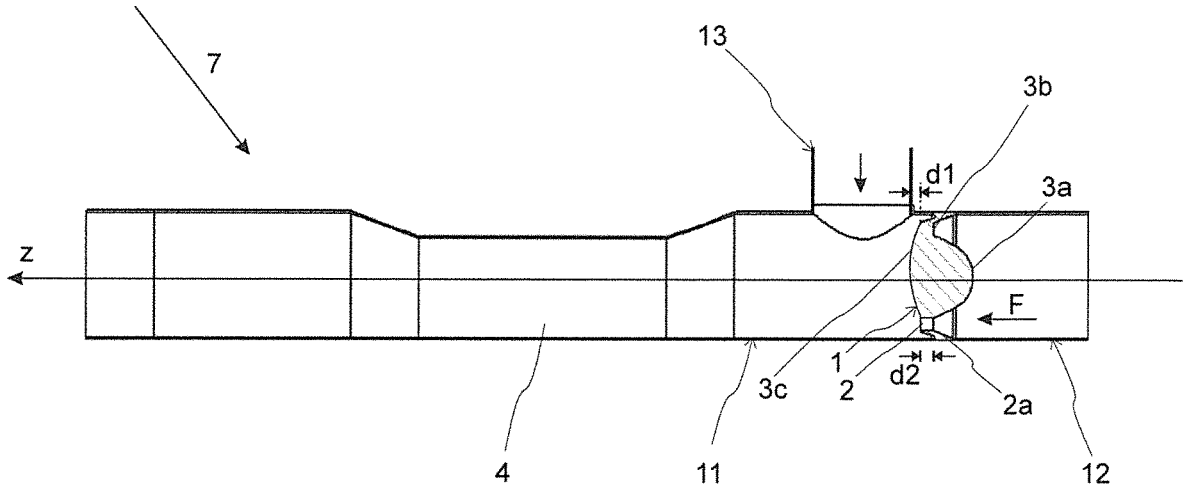
Figure 3:
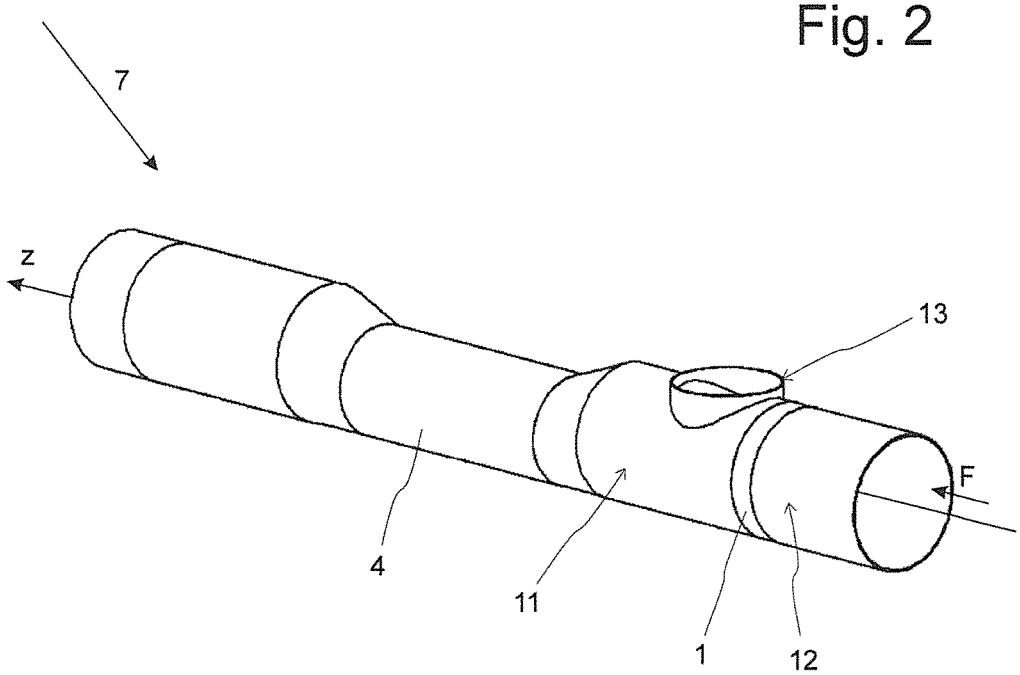
Figure 4:
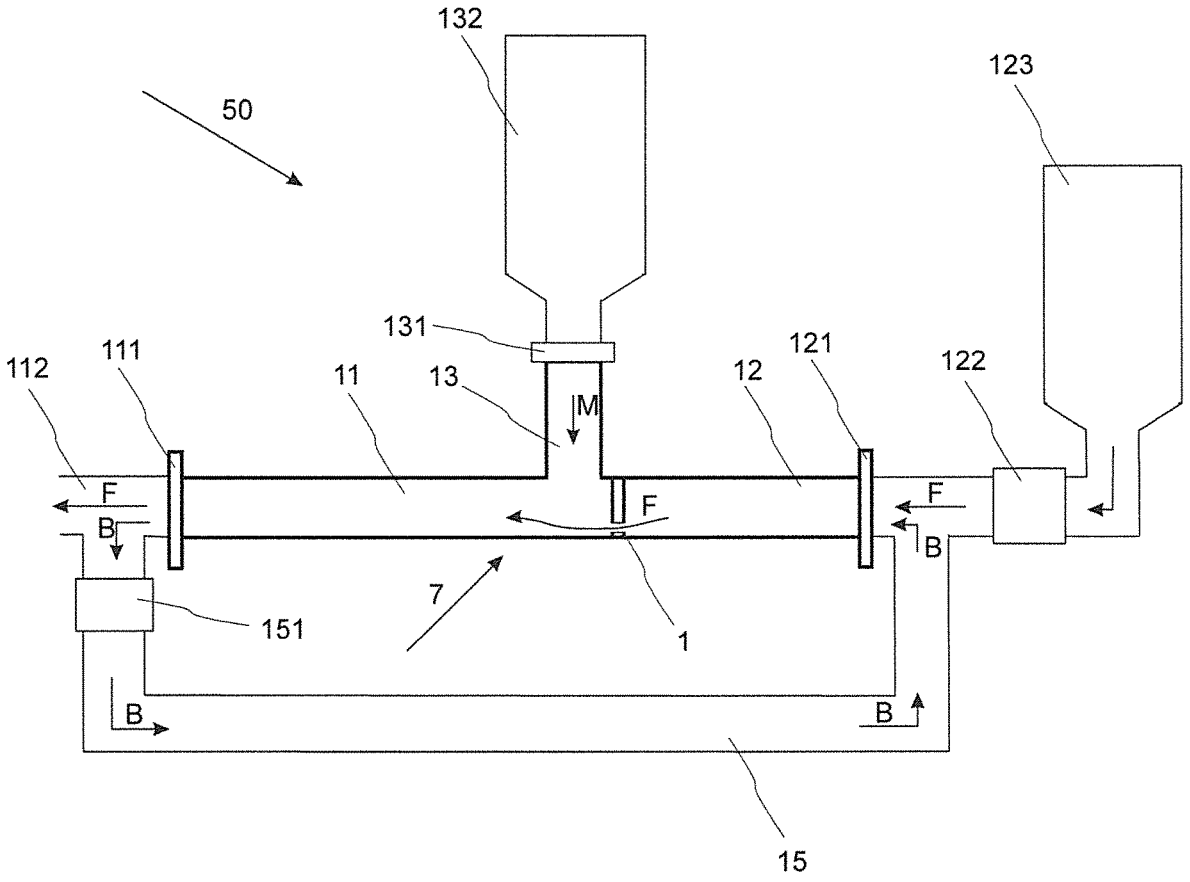

Embodiments, advantages and applications of the invention result from the dependent claims and from the now following description by means of the figures. It is shown in:

FIG. 1 a perspective view of an embodiment of a baffle pipe segment,

FIG. 2 a lateral section view of an embodiment of an injector device,

FIG. 3 a perspective view of the embodiment of the injector device of FIG. 2, and FIG. 4 a schematized view of a dissolving installation.

DETAILED DESCRIPTION

In the following same reference numerals denote structurally or functionally same elements of the various embodiments of the invention.

For the purposes of this document the term "material" refers to solid loose material like powder or granulate but also to a liquid. It is noted that the term "dissolution" used herein in the context of a liquid as the material to be inserted into the target liquid shall be understood as mixing of the two liquids and is used as generic term for simplicity reasons.

Furthermore, the material to be dissolved may also consist of multiple components which may e.g. be drawn into the target liquid from different storage containers.

In the context of the present document the terms "inner" and "outer wall" of the slit are to be understood with respect to the longitudinal axis of the dissolving device. Therefore, an inner wall is closer to said longitudinal axis than an outer wall.

The term "positive" in the context of a curvature of the baffle element shall be understood as a bead or bulge in the respective direction.

The term "flow direction" refers to a main flow direction of the target liquid or the mixed liquid, respectively, and doesn't take into account diverging local flow directions due to turbulences. It shall be understood as substantially parallel to the longitudinal axis z.

FIG. 1 shows a perspective view of an embodiment of a baffle pipe segment 1 with a longitudinal axis z. The baffle pipe segment 1 has a segment hull 8 in the interior of which a baffle element 3 is arranged. The baffle element 3 is arranged perpendicularly to the flow direction or the longitudinal axis, respectively, and has a curved section, called first positive curvature 3*a*, and a flat section 3*b*. The dimensions of the baffle element 3 are such that a slit 14 is left open for allowing passage of the target liquid from an input side to an output side of the baffle pipe segment 1.

Preferably, the slit 14 is formed as an annular space, as can be seen in FIG. 1, with an inner wall 14*a* and an outer wall 14*b*. The inner wall 14*a* is preferably formed by a section of the baffle element 3 and the outer wall is formed by the segment hull 8. It is preferred that the annular space is concentric with respect to the longitudinal axis z of the baffle pipe segment, in other words the inner wall 14*a* and the outer wall 14*b* form each a circle section with a center on the longitudinal axis z. At its ends, the slit is limited by two extremity walls 14*c* formed by the baffle element 3. These walls 14*c* are preferably rounded. In this embodiment the slit 14 is formed as an annular space but other shapes are also possible. In this context it is noted that the outer wall 14*b* of the slit is in most cases round (circle section), as it is defined by the segment hull 8 which is itself typically round following the tubular shape of normal pipes. The inner wall 14*a* may however vary from the shown shape depending on the shape of the baffle element 3. For example, the baffle element 3 may have straight sections defining the inner wall 14*a* of the slit 14.

It is preferred that the section of the circumference of the segment hull 8 along which the slit 14 extends is of maximum ⅔ of a total circumference of the segment hull 8. In this way a speed of the target liquid flowing through the slit 14 is high enough as compared with the target liquid speed across the input and output side. It is preferred that the slit 14 has a throughput area for the target liquid such that a transfer speed of the target liquid through the slit 14 is around six times higher that an input side speed of the target liquid. In a typical practical example the target liquid arrives at the slit on the input side at an input side speed of around 4 m/s and reaches a transfer speed of approximately 22 m/s to 25 m/s when passing through the slit. This illustrates exemplarily the ratio between input side speed and transfer speed.

Preferably, the first positive curvature 3*a* of the baffle element 3 forms along a section of its largest circumference an edge with at least a part of the inner wall 14*a* of the slit 14. In this way it is made sure that the target liquid impacting the first positive curvature 3*a* is smoothly diverted towards the slit 14 without causing excessive turbulence in this area, which is not desired as it slows down the average flow speed of the target liquid on the input side. It is particularly preferred that the entire inner wall 14*a* of the slit 14 is formed by the largest circumference of the first positive curvature 3*a*. In embodiments, the first positive curvature 3*a* is rotational symmetric with respect to the longitudinal axis z. It is furthermore preferred that the edge formed by the inner wall 14*a* with the first positive curvature 3*a* is rounded. This further enhances said smooth and laminar flow of the target liquid around the edge. In this context it is noted that all edges coming into contact with travelling liquid are preferably rounded.

Besides the first positive curvature 3*a* the baffle element 3 has a flat annular portion 3*b* connecting the first curvature 3*a* to the segment hull 8 and defining the two extremities 14*c* of the slit. The flat annular portion 3*b* is preferably perpendicular to the longitudinal axis z. However, the flat annular portion 3*b* may also have other orientations and/or comprise one or more curvatures. For example, the portion 3*b* may have a negative curvature with respect to the input side or it may be sloped.

In embodiments, the baffle element 1 comprises at least one second curvature 3*c* which is positive with respect to the output side, which second curvature 3*c* forms at least a section of a total surface of the baffle element 1 facing the output side. Advantageously, this measure further improves the suction effect of material into the output side by the target liquid exiting the slit on the output side. It is understood that said surface of the baffle element 1 facing the output side may also have multiple curvatures or be entirely flat, depending on the desired effects. It may e.g. be advantageous to have a corrugated surface in order to reach more turbulence in its vicinity.

FIG. 2 shows a lateral section view of an embodiment of an injector device 7 and FIG. 3 shows a perspective view of the embodiment of the injector device of FIG. 2.

The injector device 7, which may be referred to as a dissolving device, comprises a first pipe segment 11 for transporting a mixture composed of the target liquid and the material dissolved therein, a second pipe segment 12, connected to the first pipe segment 11, for supplying the target liquid into the first pipe segment 11, and a third pipe segment 13, connected to the first pipe segment 11, for supplying the material into the first pipe segment 11. Between the first and the second pipe segment 11, 12 a baffle pipe segment 1 is arranged. As can be seen from the perspective view of FIG. 3, the baffle pipe segment is aligned with the pipe walls of pipes 11, 12. Preferably, it is welded seamlessly to the pipes 11, 12. In other embodiments the baffle pipe segment 1 may be inserted e.g. into the second pipe 12 and attached therein for example by force fit, as already mentioned.

The baffle pipe segment 1 is arranged in such a way along the longitudinal axis z that the second pipe segment 12 is connected on its input side and the third pipe segment 13 is connected on its output side. The baffle pipe segment 1 has such a rotational position about the longitudinal axis z, that a distance between the slit 14 of the baffle pipe segment 1 and an outlet of the third pipe segment 13 is maximal. The term "distance" is understood as a distance between a vertex of the outer wall 14*b* of the slit 14 and a closest point of a hull of the third pipe segment 13 to a cross-section plane of the baffle pipe segment 1 at the location of the exit of the slit 14 into the output side. This will be described in the following.

Preferably, at least two thirds of the slit 14 is arranged in a bottom half of the first pipe segment 11. In other words, the slit 14 is arranged at the bottom of segment hull 8, this being the farthest possible location from the output of the third pipe segment 13. Thus, the slit is preferably positioned on an opposite side of the outlet of the third pipe segment 13, as seen in terms of cross-sectional areas.

In embodiments, an outlet of the third pipe segment 13 into the first pipe segment 11 is arranged on top of the first pipe segment 11. Preferably, the first pipe segment 11 is arranged horizontally and the third pipe segment 13 is arranged vertically at least in a connection section of the third pipe segment 13 to the first pipe segment 11, as can be seen in FIG. 2 or 3.

The chosen relative positions and orientations of the pipe segments 11, 12 as well as the chosen distance between the output of the third pipe segment 13 and the slit 14 are preferred because in this way the suction process of material from the third pipe segment 13 has been found to be very effective in fluid-dynamic simulations and prototype testing. However, other configurations of these two design aspects may be used as well. For example, the third pipe segment 13 and the first pipe segment 11 may be arranged at another mutual angle than 90°.

In the following, the suction process will be described in more detail by fluid-dynamic considerations. Particularly two parameters are decisive for the design of the baffle pipe segment 1 and the injector device 7: speeds of target liquid and pressures along the travel path of the target liquid and the liquid mixture through the injector device 7. It is desired that the target liquid has an as laminar as possible flow on the input side. Generally, turbulences cause a reduction of speed. Therefore, a laminar flow leads to a more predictable overall speed of the target liquid on the input side. Hence, a shape of the baffle element 3 surface facing the input side plays a role in influencing the flow pattern of the target liquid. A positive curvature smoothens the impact of target liquid on the baffle element 3, directing the flow towards the slit 14. Taking the above mentioned example, an average speed of the target liquid on the input side may have a value of 4 m/s. Because the baffle element 3 acts as an obstacle for the target fluid, the pressure in this area is comparatively high, for the above example amounting to around 3.4 bar. While passing through the slit 14, the target liquid gains considerably speed as the cross-section of the slit 14 is much smaller than the cross-section of the second pipe 12. In the slit 14 the speed increases to around 23 m/s. Consequently, the pressure drops inside the slit 14, in this case to about 1.3 bar. After exiting on the output side the target liquid slows down again, as the cross-section of the first pipe segment 11 is much larger than the one of the slit 14. In said example the speed gradually decreases along a main path of the liquid in longitudinal direction until the average speed along the entire cross-section has decreased to the same level as on the input side, that is 4 m/s. A steep speed gradient occurs at the exit of the slit 14, the speed of the target liquid in the middle of the stream being highest and decreasing rapidly towards the outer stream sections. However, in the area of the output side which is located above the slit, between the latter and the output of the third pipe segment 13 into the first pipe segment 11, turbulences occur due to a diversion of portions of the target liquid to this area. The liquid speed is very low here because no direct flow in longitudinal direction z occurs. The pressure pattern on the output side is substantially uniform across the cross-section of the first pipe segment 11 and increases gradually along the longitudinal axis z. As the pressure is uniform in the above mentioned area, in said example of about 1.2 bar, the liquid in this area can be "dragged" along by the main stream of the target liquid just exiting the slit 14. This causes a suction effect in substantially radial direction for the liquid in this area located behind the baffle element 3. In turn, this suction effect causes material particles from the third pipe segment to be sucked into the stream of target liquid and to be dissolved therein. It is favourable for the dissolving process that the speed of the liquid in said area is very low, because this allows more time for dissolution.

In this context it is mentioned that the second positive curvature enhances the "radial" flow of target liquid mixed with material particles in the process of dissolving, in direction of the main target liquid stream exiting the slit 14.

As mentioned at the beginning, in one embodiment of the injector device 7 the baffle pipe segment 1 is attached inside the first pipe 11 in a path of the target liquid. In this embodiment it is preferred that an end of the segment hull 8 facing the second pipe segment 12 forms a slope 2*a* on the input side towards the second pipe segment 12 in such a way that no step is present between a hull of the first pipe segment 11 and the segment hull 8. This advantageously avoids creation of turbulences in an input side area close to the slit 14. This is not desired as such turbulences would slow down the target liquid flow into the slit 14 and would therefore worsen the suction effect on the output side of the slit 14. Furthermore, in this embodiment the baffle pipe segment 1 is preferably attached by welding or force fit inside the first pipe segment 11.

Preferably, a distance d1 between the baffle pipe segment 1 and the outlet of the third pipe segment 13 substantially equals a passage distance d2 of the target liquid through the slit 14. The distance d1 is measured from the closest point of a hull of the third pipe segment 13 to a cross-section plane of the baffle pipe segment 1 at the location of the exit of the slit 14 into the output side. This ratio has been found to be optimal with respect to the creation of an effective suction of material on the output side. The longer the distance d1 is, the less accentuated is the suction process.

In embodiments, the first pipe segment 11 comprises at least one constriction 4 downstream of the outlet of the third pipe segment 13. In variations of this embodiment, the first pipe segment 11 comprises a plurality of constrictions 4 at predefined distances along its extension downstream of the outlet of the third pipe segment 13. Such constrictions further enhance the dissolution process, as pressure of the mixed liquid flowing through it increases as compared to the "normal"-diameter sections of the first pipe segment 11.

Preferably, the first pipe segment 11, the second pipe segment 12 and the third pipe segment 13 of the injector device comprise each at their free end a connection element, particularly a flange, for a connection to elements of a dissolving installation using the injector device 7. In this way the injector device can be delivered in a state ready to be directly connected to said elements.

FIG. 4 shows a schematized view of a dissolving installation 50. It is noted that FIG. 4 only shows main elements of the dissolving installation 50. It is understood that the latter may comprise a variety of other elements, like for example valves, flow meters, etc.

The dissolving installation 50 comprises an injector device 7, a first supply container 123 for providing the target liquid, connected to the second pipe segment 12 via an intermediary pipe, a first pump 122, particularly a variable flow pump, for transporting the target liquid from the first supply container 123 through the second pipe segment 12 towards the first pipe segment 11, and at least a material dosage unit 131 for regulating a quantity of the material to be supplied into the first pipe segment 11 per time unit. Furthermore, the dissolving installation 50 comprises at least one optional second supply container 132 connected to the third pipe segment 13 for providing the material to be dissolved into the target liquid. Furthermore an outlet pipe 112 is provided for guiding the liquid mixture to a further processing station, e.g. a filling station.

The flow directions are denoted by the respective arrows. According to this, a main flow direction is denoted by the arrow "F", a flow through a feedback pipe 15 defined below is denoted by the arrow "B" and a transport direction of the material to be dissolved in the target liquid is denoted by the arrow "M".

The dissolving installation 50 preferably comprises a feedback pipe 15 for recirculating the liquid mixture from an outlet of the first pipe segment 11 back to the input side of the injector device 7 and at least a second pump 151 for transporting the liquid mixture through the feedback pipe 15. It is understood that suitable valves are connected at the joints between the feedback pipe 15 and the first pipe segment 11 and the second pipe segment 12, respectively. The feedback pipe 15 accounts for cases when a solubility of the material in the target liquid is rather poor. It may therefore be necessary to employ multiple recirculation steps for a thorough dissolution. In another case it may be necessary to dissolve multiple materials in the target liquid in a consecutive way. Therefore, in a first step a first material is dissolved, whereafter the liquid mixture is recirculated and a second material is added to the liquid mixture. Although for such cases it may be desired to use a series of injector devices 7, dissolving installations with only one injector device may rather make use of the recirculation alternative if a subsequent insertion of further injector devices proves too complex or costly.

As mentioned, the dissolving installation 50 comprises a second supply container 132. In this exemplary embodiment of the dissolving installation 50 the second supply container 132 is stationary. In other embodiments, the second supply container 132 is transportable by a vehicle or it is part of a vehicle or it is a human-transportable bag. It is however noted that the connection of the second supply container 132 to the third pipe segment 13 is preferably adapted to be uncoupled from the second supply container 132 if other means for providing the material shall be used, e.g. a truck with a transportable second supply container 132.

Preferably, the dissolving installation 50 further comprises a refractometer (not shown) for measuring a density or viscosity of the liquid mixture. In this way a quality monitoring of the liquid mixture may be performed. Particularly in case of the usage of feedback pipe 15, the liquid mixture can be recirculated in case the refractometer check fails. In order to do this, a valve (not shown) switches the liquid mixture flow from a direction towards the output of the dissolving installation 50 into the feedback pipe 15.

The material dosage unit 131 regulates the amount of material fed into the first pipe segment 11. It is noted that the material dosage unit may be used to only limit the amount of material supplied and has no actuating means for material transport. This is due to the fact that in most cases the third pipe segment 13 is arranged vertically. Therefore, in these cases there is no need to transport the material to the third pipe element 13, but the material falls freely into it due to gravity. Hence, it is preferred that the second supply container 132 is arranged above the output of the third pipe segment 13 into the first pipe segment 11 in order to avoid having to use additional transport means for the material.

The target liquid flow, the liquid mixture flow and the material amount to supply are regulated by a controller (not shown) via the corresponding pump 122, 151 or the material dosage unit 131, taking into account various parameters like solubility of the material in the target liquid, desired throughput, degree of dissolution etc. Furthermore, the flow paths are also controlled by the controller, which actuates the corresponding valves according to the desired flow path.

A user interface is further provided for inputting said parameters, reading out values measured by a variety of sensors provided in the dissolving installation, and for monitoring output quality of the liquid mixture.

While there are shown and described presently preferred embodiments of the invention, it is to be distinctly understood that the invention is not limited thereto but may otherwise variously be embodied and practiced within the scope of the following claims. Therefore, terms like "preferred" or "in particular" or "particularly" or "advantageously", etc. signify optional and exemplary embodiments only.

The invention claimed is:

1. An injector device for dissolving material in a target liquid, comprising:

a baffle pipe segment for providing an obstacle in a flow of a target liquid through the baffle pipe segment, the baffle pipe segment comprising:

a tubular segment having a longitudinal axis along which the tubular segment extends, wherein the target fluid flows through the tubular segment;

a baffle, attached to the tubular segment, arranged in a path of the target liquid flowing through the tubular segment, wherein the baffle separates the baffle pipe segment into an input side arranged upstream of the baffle with respect to a flow direction of the target liquid through the tubular segment, and an output side arranged downstream of the baffle with respect to the flow direction of the target liquid through the tubular segment, a slit, formed between the tubular segment and the baffle, through which the target liquid flows from the input side to the output side, wherein the baffle further comprises:

at least one first positive curvature surface extending towards the input side and forming at least a portion of a total surface of the baffle facing the input side, an inner wall and an outer wall that delimit the slit, wherein the inner wall is formed by a wall section of the baffle that extends substantially in a direction of the longitudinal axis, and the outer wall is formed by a section of the tubular segment, wherein the slit extends in a direction perpendicular to the longitudinal axis along a section of the circumference of the tubular segment;

a first pipe segment for transporting a mixture composed of the target liquid and the material dissolved in the target liquid;

a second pipe segment, connected to the first pipe segment, for supplying the target liquid into the first pipe segment, and a third pipe segment, connected to the first pipe segment, for supplying the material into the first pipe segment, wherein either the baffle pipe segment is attached to at least one of the inside of the first pipe segment in a path of the target liquid or between the first pipe segment and the second pipe segment, wherein the baffle pipe segment is arranged perpendicular to the longitudinal axis, wherein the input side of the baffle pipe segment is connected to the second pipe segment and the output side of the baffle pipe segment is connected to the third pipe segment and centered with respect to the longitudinal axis, wherein a distance between the slit and an outlet of the third pipe segment is maximal when the slit is at a rotational position aligned with the outlet of the third pipe segment.

2. The injector device of claim 1, wherein at least two thirds of the slit is arranged in a bottom half of the first pipe segment and wherein an outlet of the third pipe segment into the first pipe segment is arranged on top of the first pipe segment.

3. The injector device of claim 1, wherein the baffle pipe segment is attached inside the first pipe segment, and an end of the tubular segment facing the second pipe segment forms a slope on the input side towards the second pipe segment in such a way that a step-less transition is between a hull of the first pipe segment and the tubular segment.

4. The injector device of claim 1, wherein a distance between the baffle pipe segment and the outlet of the third pipe segment substantially equals a passage distance of the target liquid through the slit.

5. The injector device of claim 1, wherein the first pipe segment comprises at least one constriction downstream of the outlet of the third pipe segment, wherein the first pipe segment comprises a plurality of constrictions at predefined distances along its extension downstream of the outlet of the third pipe segment.

6. A dissolving installation for dissolving a material, the dissolving installation comprising:

an injector device according to claim 1;

at least a first supply container for providing the target liquid connected to the second pipe segment;

a first variable-flow pump for transporting the target liquid from the first supply container through the second pipe segment towards the first pipe segment; and a material dosage unit for regulating a quantity of the material to be supplied into the first pipe segment per time unit.

7. The dissolving installation of claim 6, further comprising a feedback pipe for recirculating the liquid mixture from an outlet of the first pipe segment back to the input side of the injector device and at least a second pump for transporting the liquid mixture through the feedback pipe.

8. The dissolving installation of claim 6, further comprising at least one second supply container connected to the third pipe segment for providing the material to be dissolved into the target liquid.

* * * * *